US007134313B2

(12) United States Patent
Chun et al.

(10) Patent No.: US 7,134,313 B2
(45) Date of Patent: Nov. 14, 2006

(54) METHOD AND TOOL MOUNTING FOR ADJUSTMENT OF TOOLS ON A PRESS MOUNTED CAM

(75) Inventors: Victor L. Chun, Walton Hills, OH (US); Frank Madej, Mentor, OH (US); Jordan Owens, Brecksville, OH (US)

(73) Assignee: Danly IEM, LLC, Cleveland, OH (US)

( * ) Notice: Subject to any disclaimer, the term of this patent is extended or adjusted under 35 U.S.C. 154(b) by 111 days.

(21) Appl. No.: 11/027,494

(22) Filed: Dec. 30, 2004

(65) Prior Publication Data

US 2006/0144119 A1 Jul. 6, 2006

(51) Int. Cl.
*B21D 5/04* (2006.01)

(52) U.S. Cl. ..... 72/452.9; 72/304; 72/315; 83/635

(58) Field of Classification Search ..... 72/304, 72/315, 452.9; 83/635
See application file for complete search history.

(56) References Cited

U.S. PATENT DOCUMENTS 5,487,296 A * 1/1996 Gerhart et al. ..... 72/452.9
6,220,137 B1 * 4/2001 Matsuoka ..... 72/452.9
6,997,029 B1 * 2/2006 Chun et al. ..... 72/452.9
7,043,956 B1 * 5/2006 Higuchi et al. ..... 72/452.9

* cited by examiner

*Primary Examiner*—David B. Jones
(74) *Attorney, Agent, or Firm*—Schnader Harrison Segal & Lewis, LLP; Joan T. Kluger

(57) ABSTRACT

A tool mounting and method for adjustably mounting a tool holder on a cam slide of a press mounted cam also including an adapter body and driver. The tool mounting includes a tooling plate adjustably secured to the cam slide by a series of dowel pins closely fit in dowel pin openings in the cam slide and loosely fit in dowel pin holes in the tooling plate to allow vertical and horizontal adjustment. A channel extends to each oversized dowel pin opening to enable injection of a setting material to lock the tooling plate in its adjusted position after being aligned with a die opening using a pilot installed in a tool holder mounted on one side of the tooling plate. An alignment plate is installed over the other side to cover the channel to each oversized dowel pin hole and allow removal and replacement of the tooling plate without disturbing the adjusted position on the tooling plates.

10 Claims, 2 Drawing Sheets

METHOD AND TOOL MOUNTING FOR ADJUSTMENT OF TOOLS ON A PRESS MOUNTED CAM

BACKGROUND OF THE INVENTION

The present invention concerns in-press mounted devices for driving tools by the press motion. Such devices, commonly called "cams", are used to perform forming operations on portions of workpiece which cannot be done by the press motion directly. Such cams includes a cam slide advanced by the press motion to drive a tool along a direction traverse to the press motion so as to execute an operation on a workpiece in that direction. Such operations typically involve driving a punch to form a hole in the workpiece.

Such press mounted cams are described in U.S. Pat. No. 5,487,296 assigned to the same assignee as the present application. Preferred forms of such cams are described in U.S. application Ser. Nos. 11/060,082 filed on Feb. 16, 2005, now issued as U.S. Pat. No. 7,080,542, and 11/069,828 filed on Feb. 28, 2005.

It is necessary that the tool mounted on the cam slide is accurately aligned with the location of the mating tool on the die so that the cam mounted tool properly mates with the tool mounted on the die when the slide is driven towards the die by the press motion.

The tool may be for piercing, trimming, bending, drawing, etc.

This necessitates a tedious time consuming set up process, such as described in U.S. Pat. No. 5,487,296.

Such press mounted cams are comprised of three main components, an adapter body mounted to the upper platen or a die shoe mounted to the upper platen, a slider mounted on the adapter body so as to accommodate sliding movement to drive the tool affixed thereto, and a driver mounted on a lower platen or die shoe mounted thereto.

When the slide engages the driver, further press motion creates a camming action driving the slider in a direction transverse to the press motion, the tool mounted to project from the slide so as, for example, punch a hole in workpiece when the punch is driven through a workpiece section and into the punch die. For piercing, the punch die mates with the punch in use, and so the punch must be properly aligned with the punch die when a hole is being punched.

Since it is impossible due to tolerance build up to install the cam components with sufficient accuracy to align the punch perfectly with the punch die, an in-press adjustment of the tool position must be done. This is complicated by the relative inaccessibility of the tool mounting when the cam components are installed in the press. In the past, this was done by making sideway adjustments and front to back adjustments when installing the driver to move the punch correspondingly into alignment. This in turn required the adapter to be installed later so as to be properly aligned with the driver.

Alternatively, the tool holder can be adjusted when being mounted on the slide, but this requires complete removal of the slide for doweling the tool holder to the slide in its adjusted position since this cannot be done in the die due to difficulty in accessing the cam.

In either event, a tedious time consuming procedure is entailed.

It is the object of the present invention to provide a method and tool mounting for a press mounted cam which reduces the time and effort required to set up a tool in proper alignment.

SUMMARY OF THE INVENTION

The above object and other objects which will become apparent upon a reading of the following specification and claims are achieved by use of a tooling plate adjustably mounted to the tooling face on the cam slide by a set of projecting dowel pins.

The tooling plate is formed with a corresponding set of oversized dowel pin holes, receiving the dowel pins with a substantial clearance space to accommodate adjusting movement. A tool holder is affixed to one side of the tooling plate and an alignment pilot is installed therein. The entire assembly is loosely attached to the slide tooling face, and the cam slide is advanced to bring the pilot into engagement with a feature to be in alignment with a tool, such as a punch die located adjacent the point where a hole is to be formed in a workpiece. The tooling plate is adjusted up and down and sideways as necessary to align the pilot with the punch die opening.

The tooling plate has an injection port communicating with a channel leading to the oversize dowel pin holes. Epoxy resin or other setting material is injected through the port to fill the clearance spaces and lock the adapter plate in its adjusted position when the material cures.

An alignment plate may overlie the other side of the tooling plate to cover the channel to the oversize dowels so as to contain the setting material and allow removal and later reinstallation of the tooling plate without disturbing the alignment adjustments previously made. The dowels extend through closely fit holes in the alignment plate and into the slide tooling face.

Mounting screws then tightened after adjustments are made to secure the adjustments until the setting material is injected and cured.

The cam slide then can be retracted or removed to allow installation of the punch or other tool in the tool holder after removal of the pilot in preparation for beginning regular operations.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
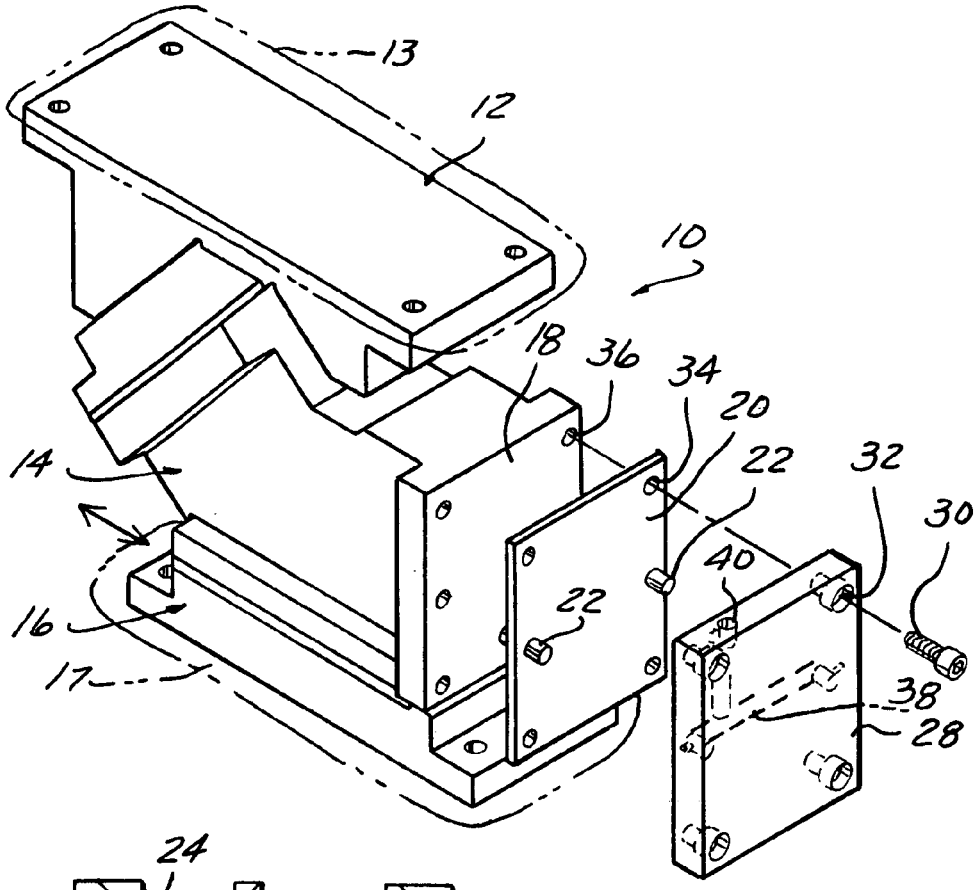
FIG. 1 is a pictorial exploded view of a press mounted cam and the tool mounting components according to the present invention.
Figure 2:
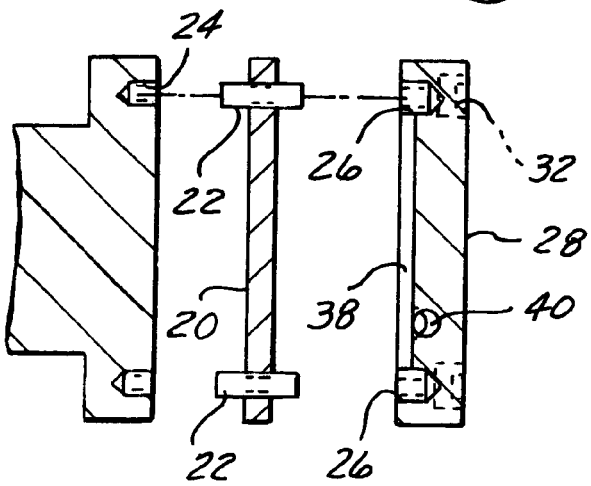
FIG. 2 is an exploded partially sectional view of the tool mounting components shown in FIG. 1 with a fragmentary portion of the cam slide.

Referring to the drawings, and particularly FIG. 1, a press mounted cam 10 is shown, which includes an adapter body 12 mounted on an upper die shown secured to the press upper platen (not shown), a slide 14 suspended on the adapter 12, and driver 16 mounted on the lower die shoe affixed to the lower press platen (not shown).

A front face 18 of the cam slider 14 is adapted to have a tool mounting assembly according to the invention mounted thereto.

When the press is operated, the adapter body 12 and slide 14 are lowered to bring the slide 14 into engagement with the driver 16, with inclined mating surfaces causing the slide 14 to be cammed to be advanced in a transverse direction to drive a forming tool mounted thereon to form a feature on a workpiece in the press.

Such cam devices are well known in the art, and are described in U.S. Pat. No. 5,487,296 assigned to the same assignee as the present application, and copending U.S. application Ser. No. 11/060,082 field on Feb. 16, 2005 and Ser. No. 11/069,828 filed on Feb. 28, 2006.

The tool mounting assembly according to the present invention comprises an alignment plate 20 having a set of two dowel pins 22 press fitted into holes machined therein. The dowel pins 22 protrude out from both sides of the alignment plate 20. The rearwardly projecting portion of each dowel pin 22 is slidingly fit into a machined hole 24 in the cam slide face 18. The forwardly projecting portion of each dowel pin 22 is received in oversize dowel pin holes 26 in the rear face of a tooling plate 28 covered by the alignment plate 20.

The tooling plate 28 and alignment plate 20 are secured to the cam slider tooling face 18 by a set of machine screws 30 passing through aligned holes 32, 34 in the alignment plate 20 and tooling plate 28 respectively and received in threaded holes 36 in the cam slider face 18.

The dowel holes 26 in the tooling plate 28 are oversized to temporarily allow adjusting movement of the tooling plate 28 either in an up or down or sideways direction. The screws 36 are loosely installed and have sufficient clearance with the screw holes 34 to allow vertical and horizontal adjustment of the tooling plate 28.

An injection channel 38 is formed into the rear face of the tooling plate 28 extending to the oversized dowel holes 26 and communicating with an injection port 40 at the top of the tooling plate 28.

The alignment plate 20 in being stacked over the rear side of the tooling plate 28 closes off the channel 38 to confine the injected setting material, and allows removal and replacement of the assembly without disturbing the adjusted position of the tooling plate 28 relative the dowel pins 22.

Figure 3:
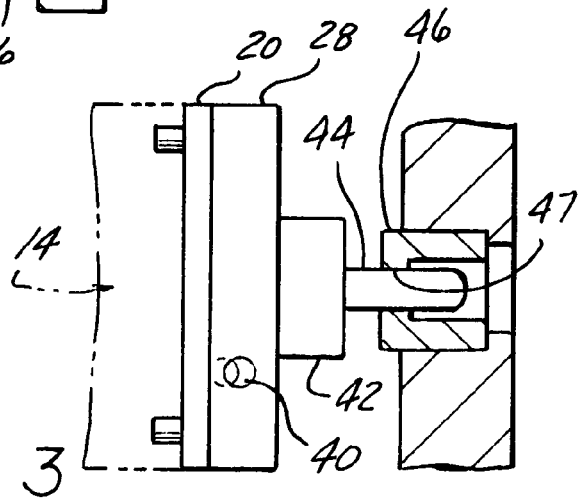
FIG. 3 is a partial sectional plan view of the assembled tool mounting components in engagement with a punch die, with a portion of the cam slide shown in phantom lines.
Figure 4:
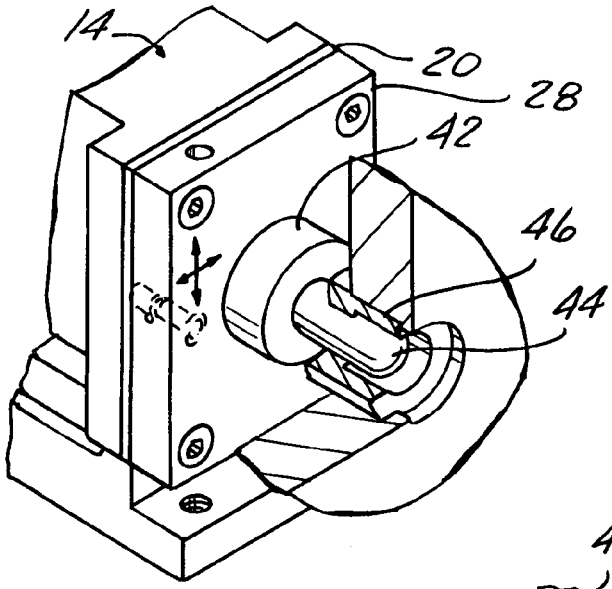
FIG. 4 is a pictorial view of the assembled tool mounting components installed on a cam slide shown in fragmentary form adjacent a workpiece fixture with a punch die in partial section, and a tool holder and pilot installed on the tooling plate.
Figure 5:
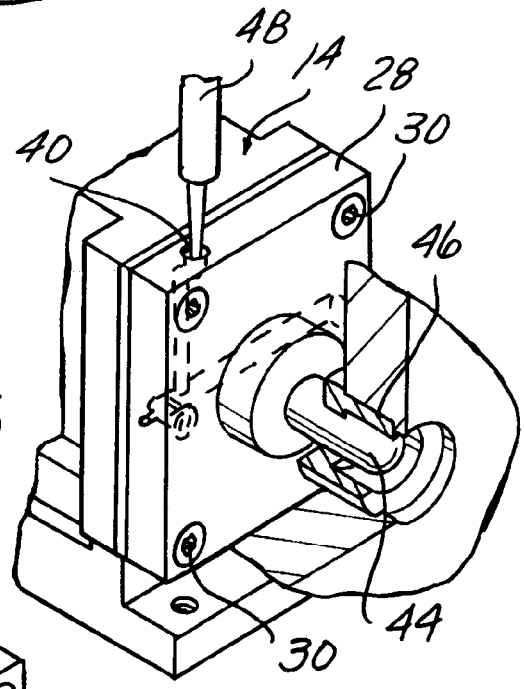
FIG. 5 is a pictorial view of the components as shown in FIGS. 3 and 4 with a depiction of the injection of setting compound material to the channels shown in hidden lines.
Figure 6:
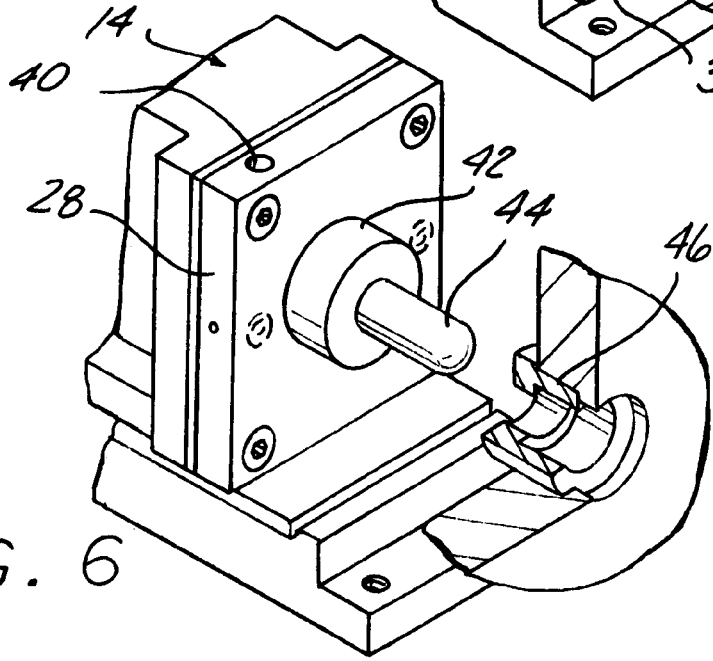
FIG. 6 is a pictorial view of the components shown in FIG. 4 with the cam slide retracted to withdraw the pilot from the die.

In carrying out the method of the present invention, a tool holder 42 (FIG. 3) is attached to one side of the tooling plate 28 and an alignment pilot 44 is installed therein instead of a tool such as a punch. The assembly is loosely secured to the cam slide 14 by the screws 30. The adapter body 12 would normally have been removed or not yet installed to allow this.

The cam slide 14 is positioned on the driver 16 and then advanced (by hand) to insert the pilot 44 into an opening 47 of a die 46 mounted to the lower press platen, with vertical and horizontal adjustments of the tooling plate 28 as necessary to achieve this. The screws 30 may be tightened at this time.

A liquid setting material such as an epoxy resin is injected into port 48 to flow through the channel 38 and into the clearance between the dowel pins 22 and oversize holes 26, to eliminate the clearance space in the dowel holes 26. The tightened screws 30 maintain the alignment while the setting material cures.

The cam slide 14 is then retracted and assembled to the adapter 12 after the adapter is installed in the press.

The adapter body 12 and driver 16 can be installed separately due to the clearances provided in the T block support of the adapter as described in detail in copending application Ser. No. 11/060,082 filed on Feb. 16, 2005 and Ser. No. 11/069,828 filed on Feb. 28, 2006.

The pilot 44 is removed and a tool installed in the holder 42 in preparation to begin regular production operations after curing of the setting compound is complete.

The cured setting material is able to rigidly secure the alignment and solidly resist the loads imposed during the forming operations.

As can be appreciated by one of ordinary skill in the art, the process can be carried out much more quickly and easily than the prior methods.

The tooling plate assembly including the alignment plate 20 can be removed and later replaced without disturbing the alignments when a changeover is desired due to the dowel pin mounting of the assembly to the cam slide 14.

The invention claim is:

1. In a press mounted cam including an adapter body mounted on one press platen, a cam slide mounted on the adapter body, and a driver mounted on the other press platen engaging the cam slider upon press operation, the cam slide thereby driven laterally by press motion, a method of aligning a tool mounted in tool holder on said cam slide with a feature of a structure fixed relative another platen of said press, comprising:

installing a tooling plate mounted on said cam slide so as to be shiftable in a vertical and horizontal directions by providing interfit dowel pins and oversized dowel pin holes securing said tooling plate to said cam slide;

inserting a pilot in a tool holder mounted to said tooling plate;

advancing said cam slide to engage said pilot with said feature while adjusting the vertical and horizontal position of said tooling plate on said cam slide as necessary;

filling said oversize dowel pin holes with a setting material to lock said tooling plate in said adjusted position; and retracting said cam slide and replacing said pilot with a tool installed in said tool holder.

2. The method according to claim 1 wherein said filling of said oversized dowel pin holes includes injecting said setting material into a channel in said tooling plate extending to each of said oversized dowel pin holes.

3. The method according to claim 2 further including covering said channel by installing an alignment plate over one side of said tooling plate.

4. The method according to claim 3 wherein said dowel pins are press fitted into holes in said alignment plate and caused to protrude out from one side of said alignment plate and into said oversized dowel pin holes in said tooling plate and caused to protrude out another side of said alignment plate and into slidably fit dowel holes in said cam slide.

5. The method according to claim 1 further including installing screws passed through oversized holes in said tooling plate and received in said slide, and tightening said screws after carrying out said adjustment of said tooling plate.

6. A tool mounting for enabling alignment of the position of a tool mounted on a cam slide of a press mounted cam with an opening in a die mounted in said press, said cam including said cam slide, an adapter body mounted on press platen and mounting said cam slide for lateral motion thereon, and a driver mounted to the press platen and caused to become engaged with said cam slide by continued press motion, comprising:

a tooling plate;

a series of dowel pins each having one end closely fit into holes in said cam slide and received in a respective one of a series of oversized dowel pin holes in one side of said tooling plate; and, a tool holder mounted on the other side of said tooling plate.

7. The tool mounting according to claim 6 further including a channel associated with each oversized dowel pin hole, and an injection port communicating therewith to enable injection of a setting material into each oversize dowel pin hole to fill clearance spaces around said dowel pins inserted into said oversized dowel pin holes and secure said dowel pins therein in any adjusted position of said tooling plate.

8. The tool mounting according to claim 7 further including an alignment plate positioned against said one side of said tooling plate to overlie and cover said channel extending to each of said oversized dowel pin holes.

9. The tool mounting according to claim 8 wherein said alignment plate has a series of dowel pin holes press fit to a respective one of said dowel pins protruding from either side thereof to be able to be slidably received in said cam slide dowel pin holes and said tooling plate oversized dowel holes.

10. The tool mounting according to claim 9 wherein said alignment plate and said tooling platen each have a series of aligned screw holes for receiving screws to fasten said alignment plate and tooling plate to said cam slide, said screw holes in said tooling plate oversized to accommodate lateral and vertical adjusting movement of said tooling plate.

* * * * *